United States Patent [19]

Kaulins

[11] 3,978,652

[45] Sept. 7, 1976

[54] FORMED CONTACT SPRING FOR ELECTRO-MECHANICAL WATCHES

[75] Inventor: Edward Kaulins, New Milford, Conn.

[73] Assignee: Timex Corporation, Waterbury, Conn.

[22] Filed: June 19, 1975

[21] Appl. No.: 588,526

[52] U.S. Cl. ..... 58/23 D; 58/28 D

[51] Int. Cl.[2] ..... G04C 3/04

[58] Field of Search ..... 58/28 R, 28 A, 28 B, 58/28 D, 107, 114, 23 D; 200/61.39; 310/27, 36–39; 318/131, 134; 335/229

[56] References Cited

UNITED STATES PATENTS

| | | | |
|---|---|---|---|
| 750,492 | 1/1904 | Schmidt | 58/28 R |
| 3,529,415 | 9/1970 | Wuthrich | 58/28 A |
| 3,698,179 | 10/1972 | Kaulins | 58/28 R |
| 3,699,762 | 10/1972 | Zatsky | 58/28 D |

*Primary Examiner*—L. T. Hix
*Assistant Examiner*—Vit W. Miska

[57] ABSTRACT

A contact spring for making repetitive electrical contact with a contact pin on an oscillating balance wheel in a electro-mechanical watch. The contact spring is flat for maximum flexibility and has an end crimped to provide opposite identical rigid contact surfaces designed to control wear and provide self-cleaning action with optimum electrical contact.

4 Claims, 8 Drawing Figures

FORMED CONTACT SPRING FOR ELECTRO-MECHANICAL WATCHES

BACKGROUND OF THE INVENTION

Figure 1:
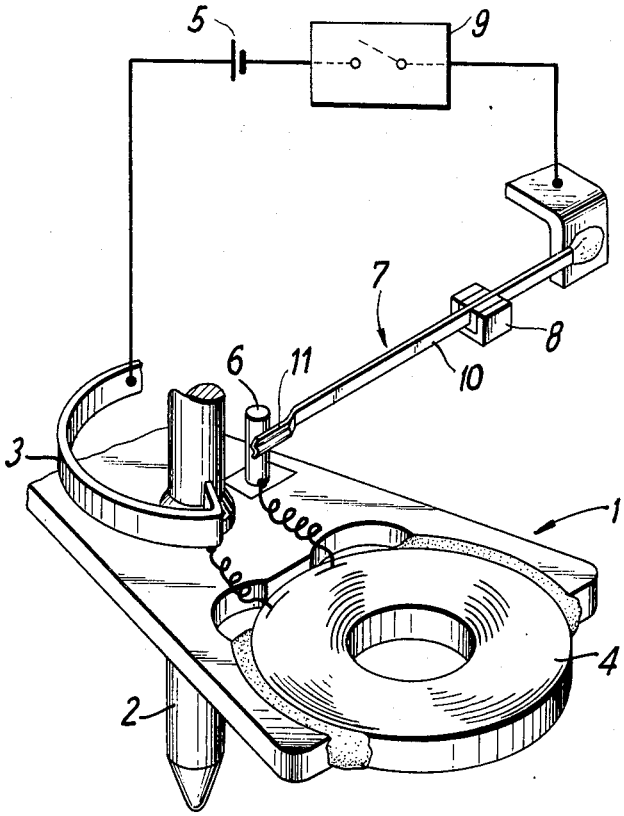

This invention relates generally to electrical contact springs used in electro-mechanical horological devices of the type having an oscillating balance wheel driven by a miniature electric coil and magnet system. Examples of such watches are seen in U.S. Pat. No. 3,140,376 issued July 7, 1964 to W. Tilse et al or U.S. Pat. No. 3,699,762 issued Oct. 24, 1972 to Zatsky.

The simplest type of contact spring is a flat spring which is wiped in alternate directions by an electrically conductive pin on the balance wheel as is shown in U.S. Pat. No. 3,529,415 issued Sept. 22, 1970 to Wuthrich or U.S. Pat. No. 3,698,179 issued Oct. 17, 1972 to Kaulins. However a flat spring does not provide the best electrical contact or self-cleaning action. Another type of contact spring is a round cross section spring wire which provides good cleaning action, but which is stiff and interferes with proper operation of the balance wheel. Other constructions have been suggested in the prior art for forming the ends or controlling the contact area on the ends of the contact spring, but these are expensive due to the extremely small dimensions of the contact spring which is, for example, on the order of 7½ millimeters long, 0.15 millimeters wide and 0.025 millimeters thick. Examples of the aforementioned prior art shown in the drawings.

Accordingly, one object of the present invention is to provide an improved construction for a contact spring for an electro-mechanical watch which is inexpensive, and flexible while providing proper electrical contact and self-cleaning action.

Another object of the invention is to provide a less expensive and more effective construction for a contact spring in an electric watch.

SUMMARY OF THE INVENTION

Briefly stated, the invention comprises an improvement in an electric watch of the type having an oscillating balance wheel with electrical contact pin and means to effect driving impulses of the balance wheel repetitively when contact is made with the pin by a contact pin. The improvement comprises a straight contact spring member with a flat flexing portion and a terminating end portion symmetrically formed to present opposite identical rigid contact surfaces of minimum cross section to the contact pin. The end portion is preferably crimped on both sides in a symmetrical manner into an S-shaped cross section or is twisted 90 degrees to present alternate edge surfaces to the balance wheel contact pin.

IN THE DRAWING

Figure 2:
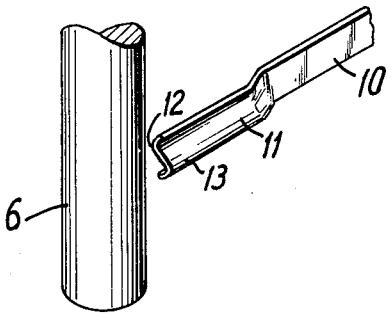
Figure 3:
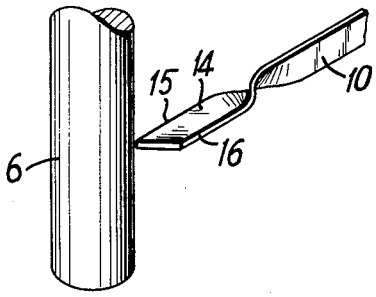

FIG. 1 is a schematic representation of the balance wheel and electrical circuit with the balance wheel coil, FIG. 2 is an enlrged perspective view of a preferred form of the invention, FIG. 3 is an enlarged perspective view of an alternate form of the invention, and FIGS. 4*a* through 4*e* are similar perspective views of acknowledged prior art constructions for contact springs.

DESCRIPTION

Referring now to FIG. 1 of the drawing, a symbolic representation is shown of a balance wheel driving system of the general type with which the present invention is intended to operate. Briefly, the balance wheel 1 is mounted for oscillatory movement on a staff 2 with an electrically conductive spiral hairspring 3 for returning the balance wheel after it is given an impulse by an electric coil 4 coacting with a permanent magnet system (not shown). One end of the coil is connected to the hairspring 3 which, in turn, is connected to a battery 5. The other end of the coil 4 is connected to an electrically conductive balance wheel pin 6 for making repetitive wiping contact with a contact spring 7 which is the object of the present invention. Although not material to the present invention, the spring member may include a mechanical damping construction 8, and electrical impulses may be synchronized by means of an electrically controlled switch 9 which is controlled by an integrated circuit and quartz oscillator (not shown). The synchronizing arrangement may operate in the manner of the aforementioned U.S. Pat. No. 3,699,762, while the assembly for holding the contact spring may be according to the aforementioned U.S. Pat. No. 3,698,179, both of which are incorporated herein by reference.

In accordance with the present invention, spring member 7 is a simple flat spring strip disposed with its flat flexing portion 10 normal to the plane of oscillation of the balance wheel 1 for maximum flexibility and minimum interference with the balance wheel action in a manner well known in the art. The terminating end portion 11 of contact spring 7 is crimped symmetrically to form a S-shaped or sinusoidal cross section. Depending upon the crimping tool, it could also take on a Z-shaped appearance.

Reference to FIG. 2 of the drawing shows an enlarged perspective of the preferred form of the invention. The crimping tool used in manufacture of the spring has provided an S-shaped configuration with one crown 12 arranged to present a rigid surface of minimum contact area to the balance wheel pin 6 on one side of the spring and an identical crown 13 on the other side of the spring for the return swing of the balance wheel. Rigidity is provided by the S-shaped cross section, and optimum electrical contact with consequent self-cleaning action is provided by the crown contact surfaces 12, 13.

Referring to FIG. 3 of the drawing, an alternate construction employs a straight terminating end portion 14 which is twisted 90 degrees from the flexing portion 10 of the spring. In this manner, the alternate edges 15, 16 are brushed by pin 6 providing a rigid minimum surface contact area for optimum electrical contact and self-cleaning action.

Figure 4A:
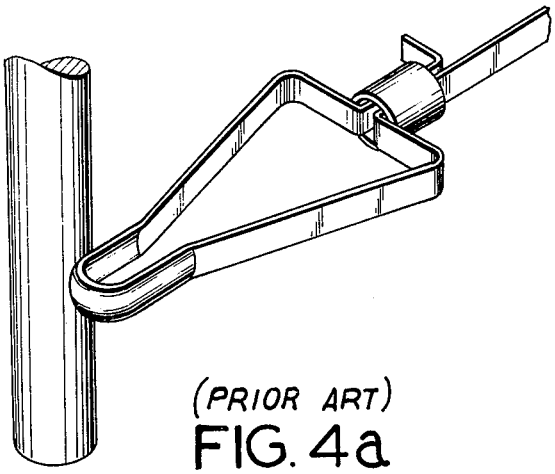
(PRIOR ART) FIG. 4a
Figure 4B:
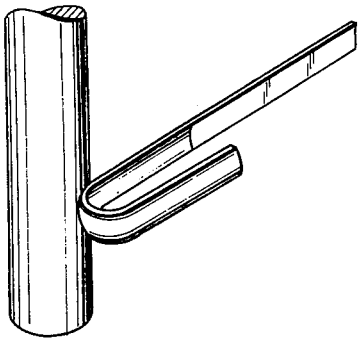
(PRIOR ART) FIG. 4b
Figure 4C:
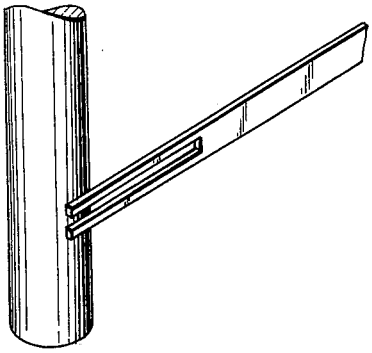
(PRIOR ART) FIG. 4c
Figure 4D:
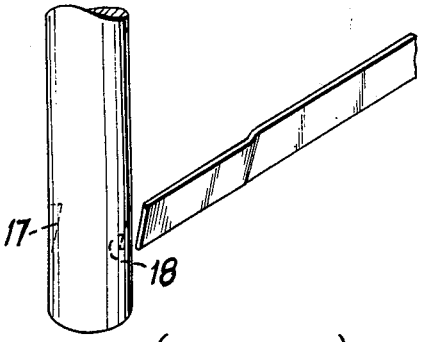
(PRIOR ART) FIG. 4d
Figure 4E:
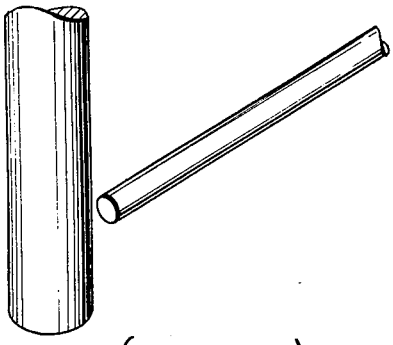
(PRIOR ART) FIG. 4e

Prior art constructions are shown in FIGS. 4*a* – 4*e*. The constructions of FIGS. 4*a* and 4*b* with U-shaped double ends of arcuate cross section are operationally good, but expensive to manufacture. The construction of FIG. 4*c* offers manufacturing difficulties as well. The construction of FIG. 4*d* which twists the end at a small angle is partially successful, but soon wears the pin on opposite sides as indicated at 17, 18 and causes undesirable vertical movements. The construction of FIG. 4*e* provides a spring which is too stiff.

The construction of the present invention provides a very simple solution of means of a simple crimping or twisting operation on the end of the flat spring without requiring blanking or elaborate forming tools. Identical wearing surfaces are presented to the balance wheel pin with small surface area for good electrical contact and self-cleaning action over the millions of electrical contacts which the contact spring must make during its expected operating life.

While the invention has been shown in its preferred form, other modifications will occur to those skilled in the art, and it is intended to cover in the appended claims all such modifications as fall within the true spirit and scope of the invention.

We claim:

1. In an electro-mechanical timekeeping device of the type having an oscillating balance wheel with an electric contact pin thereon and having means to effect driving impulses of said balance wheel repetitively as controlled by alternately striking a contact spring, the improvement in said contact spring comprising:

a straight contact spring member having a flat flexing portion adapted for orientation normal to the plane of oscillation of said balance wheel, said contact spring having a straight terminating end portion adapted for contact on opposite sides by said pin, said end portion being crimped so as to present opposite identical rigid contact surfaces of minimum surface area to said pin.

2. The combination according to claim 1, wherein said terminating end portion is crimped to provide an S-shaped cross section with opposite crowns of the S providing said contact surfaces.

3. The combination according to claim 1, where said end portion is crimped to rotate the end portion 90°, whereby said opposite contact surfaces are provided by the opposite edges of the spring member.

4. In an electro-mechanical timekeeping device of the type having an oscillating balance wheel with an electric contact pin thereon and having means to effect driving impulses of said balance wheel repetitively as controlled by alternately striking a contact spring, the improvement in said contact spring comprising:

a straight electrically conductive spring member having a flat flexing portion adapted for orientation normal to the plane of oscillation of said balance wheel and having a straight terminating end portion, said end portion being crimped in an S-shaped cross section and arranged so that the opposite crowns of the S serve as opposite identical rigid contact surfaces to present a minimum contact surface to said pin for improved electrical contact and self-cleaning action.

* * * * *